United States Patent [19]

Anderson

[11] Patent Number: 4,702,165

[45] **Date of Patent: * Oct. 27, 1987**

[54] FLUID PRESSURE SCREEN PRINTING APPARATUS, HOLDER AND ASSEMBLY

[76] Inventor: Ronald C. Anderson, 1515 Woodland Dr., Pittsburg, Kans. 66762

[ * ] Notice: The portion of the term of this patent subsequent to May 27, 2003 has been disclaimed.

[21] Appl. No.: 713,774

[22] Filed: Mar. 19, 1985

Related U.S. Application Data

[63] Continuation-in-part of Ser. No. 597,503, Apr. 6, 1984, Pat. No. 4,590,854.

[51] Int. Cl.[4] ..... B41F 15/30; B41F 15/38; B41F 17/00

[52] U.S. Cl. ..... 101/114; 101/126; 101/128.1; 101/35; 248/220.1

[58] Field of Search ..... 101/128.1, 127.1, 114, 101/119, DIG. 12, 35, 123, 124, 129, 126; 248/220.1

[56] References Cited

U.S. PATENT DOCUMENTS

| | | | |
|---|---|---|---|
| 576,623 | 2/1897 | Schreurs . | |
| 798,528 | 8/1905 | Ostwald . | |
| 804,425 | 11/1905 | Mountford | 101/115 |
| 1,894,530 | 1/1933 | Bernardo | 104/114 |
| 2,034,003 | 3/1936 | Shurley | 101/115 |
| 2,152,274 | 3/1939 | Papazian | 101/114 |
| 2,203,457 | 6/1940 | Dichter | 101/114 |
| 2,218,451 | 10/1940 | Heyne | 101/127.1 X |
| 2,484,671 | 10/1949 | Bauman | 101/114 |
| 2,491,910 | 12/1949 | Schinske | 101/129 X |
| 2,547,554 | 4/1951 | Beckelman | 101/114 |
| 2,621,592 | 12/1952 | Faeber | 101/DIG. 12 |
| 2,793,586 | 5/1957 | Arelt | 101/123 |
| 2,904,916 | 9/1959 | Stahmann | 41/1 |
| 3,172,358 | 3/1965 | Weiss | 101/126 |
| 3,221,648 | 12/1965 | Weiss | 101/129 |
| 3,294,018 | 12/1966 | Heonis | 101/115 |
| 3,372,638 | 3/1968 | Tripp | 101/114 |
| 3,374,731 | 3/1968 | Thorne | 101/129 |
| 3,427,964 | 2/1969 | Vasilantone | 101/115 |
| 3,460,470 | 8/1969 | Green et al. | 101/115 |
| 3,744,922 | 7/1973 | Fears | 101/114 |
| 3,745,970 | 7/1973 | Scantlebury | 118/50 |
| 4,048,918 | 9/1977 | Peck | 101/114 |
| 4,084,504 | 4/1978 | Fuchs | 101/115 |
| 4,164,183 | 8/1979 | Peck | 101/114 |
| 4,266,476 | 5/1981 | Maloof | 101/35 |
| 4,314,503 | 2/1982 | Perra, Jr. et al. | 101/41 |
| 4,381,706 | 5/1983 | Harpold | 101/127.1 |
| 4,590,854 | 5/1986 | Anderson | 101/35 |

FOREIGN PATENT DOCUMENTS

| | | | |
|---|---|---|---|
| 1175156 | 3/1959 | France | 101/114 |
| 2452380 | 10/1980 | France | 101/114 |
| 591691 | 4/1959 | Italy | 101/114 |
| 660210 | 2/1964 | Italy | 101/114 |
| 362891 | 6/1930 | United Kingdom | 101/114 |
| 1009740 | 11/1965 | United Kingdom | 101/114 |
| 262117 | 1/1970 | U.S.S.R. | 101/114 |
| 921879 | 4/1982 | U.S.S.R. . | |

OTHER PUBLICATIONS

"Product Information Catalog", KC Graphics,Inc., Kansas City, Kans., pp. 238–239.

"Screen Printing Supplies & Equipment", The Jay Products Company, Cincinnati, Ohio, pp. 48–60.

*Primary Examiner*—Clifford D. Crowder

*Attorney, Agent, or Firm*—Webb, Burden, Robinson & Webb

[57] ABSTRACT

Screen printing apparatus for directly printing indicia on a substrate, such as a cap, comprising a screen print assembly including a replaceable screen holder, means for introducing fluid under constant pressure to said screen holder, and means on said screen holder for mounting a sensitized screen, especially a curved screen, upon which viscous ink can be placed; and means for mounting a substrate for printing thereon by contacting said screen to said substrate and introducing fluid under pressure to said holder to force said ink through said sensitized screen to print indicia on said substrate.

17 Claims, 9 Drawing Figures

FLUID PRESSURE SCREEN PRINTING APPARATUS, HOLDER AND ASSEMBLY

RELATED APPLICATIONS

This application s a continuation-in-part of application Ser. No. 597,503 filed Apr. 6, 1984, now U.S. Pat. No. 4,590,854, entitled "Screen Printing Method and Apparatus."

BACKGROUND OF THE INVENTION

1. Field of the Invention

This invention relates to a screen printing apparatus and more particularly to an improved apparatus for directly printing indicia on a substrate. More particularly, the invention relates to an improved apparatus for printing indicia, such as designs, letters, numbers and/or words, for example, on caps, hats, T-shirts, and the like for information, promotion, and/or aesthetic purposes with the use of a screen print assembly in an apparatus which incorporates a flat or curved screen and a cap mount assembly for cooperation therewith. In a preferred form of the apparatus, a screen is provided which is so constructed that it fits securely in the apparatus and is adapted to be tightened thereon. The securing means is a feature of the invention which permits the screen to be easily and quickly mounted and replaced, particularly a curved screen which must be properly secured in the screen assembly.

In addition, the preferred direct screen printing apparatus according to the invention provides for mounting and replacement of a portion of the screen print assembly, namely the screen holder or can, such that a plurality of screen holders, each having a pre-sensitized screen, can be prepared for use in the screen printing apparatus so that, for example, different indicia can be printed on caps in a continuous assembly process and/or different inks and/or colors of inks can be used for the printing.

2. Description of the Prior Art

As set forth in U.S. Pat. No. 4,540,854, which is incorporated herein by reference in its entirety, various techniques have been used to print indicia on substrates. A number of patents have issued both in the United States and in countries foreign to the United States which disclose methods and apparatus for such printing.

None of the prior apparatus, however, includes means for quickly and easily replacing the entire screen holder in the screen print assembly forming a part of the apparatus nor do they disclose any means for quickly and easily replacing the screen in the screen print assembly, particularly a curved screen which must be properly secured.

SUMMARY OF THE INVENTION

The present invention is directed to an apparatus for directly printing indicia on a substrate comprising a screen print assembly including a screen holder, a screen, means for mounting the screen to the screen holder, and a cap mount assembly for cooperation therewith. In a preferred embodiment the screen print assembly and cap mount assembly are adapted to be used as one station of a multi-station printing apparatus and the screen holder is adapted to be removed from the assembly as a unit and replaced by another screen holder. By providing for replacement of one screen holder with another, a number of screen holders may be prepared, each having a pre-sensitized screen for use in a single screen print assembly. This permits the prepared screen holders to be provided with screens for printing different indicia using, for example, inks of different consistency depending upon the compositions of the substrate to be printed and/or inks of differing color.

The invention also concerns an improved apparatus for mounting a screen on the screen holder such that one screen can be replaced with another quickly and easily. The screen may be flat or curved and is positively preregistered and located with respect to the screen holder and secured thereon by a mounting means which permits the screen to be secured such that the screen fabric is precisely taut for printing of an indicia on a substrate mounted on a mount assembly and in contact with the screen surface.

The apparatus is particularly applicable to printing of indicia on substrates using a constant pressure compressed air as a fluid as disclosed in U.S. Pat. No. 4,590,854, incorporated herein. The present apparatus improves upon the efficiency of the method disclosed therein because it provides a screen holder which includes an improved fluid seal and screen mounting which insures reliable, consistent contact between the screen surface and the substrate to be printed.

The apparatus is particularly adapted for use as one station of a multi-station printer such as the Hix Rotary Printer illustrated on page 28 of the publication entitled "Screenprinting" of March 1985 by the Signs of the Times Publishing Company, 407 Gilbert Avenue, Cincinnati, Ohio. By substituting the present apparatus for one or more of the six stations of the Hix Rotary Printer, a modular, continuous, direct cap printing apparatus is provided.

DETAILED DESCRIPTION OF THE DRAWINGS

Figure 1:
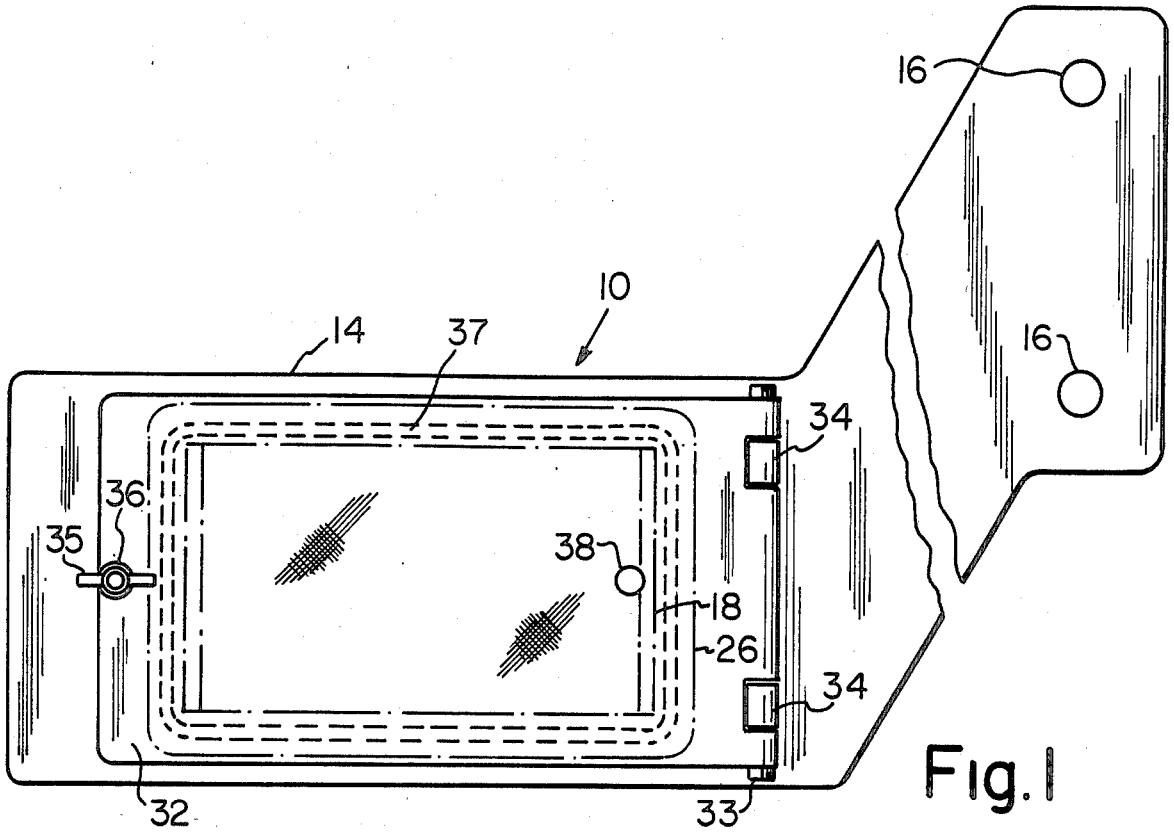
FIG. 1 is a top plan view of the preferred screen print assembly according to the present invention.

As disclosed in U.S. Pat. No. 4,590,854, direct screen printing without the use of a squeegee is carried out by using compressed air under pressure to force ink from a viscous ink supply on one surface of a prepared screen through the screen fabric the opposite surface of which is in contact with a substrate, such as a cap, and onto the substrate. The pressure of the air is constant and is applied via a sealed screen holder or can for a predetermined time at predetermined pressure to provide a quality printed image on the substrate. The method disclosed utilized an apparatus which is fully described in Pat. No. 4,590,854 and need not be repeated herein. The present invention is an improved apparatus for practicing the aforementioned printing method by providing, inter alia, for quick and facile replacement of one screen holder by another, for better sealing of the compressed air in the screen holder and for more secure mounting of the screen. In addition, the preferred apparatus shown in the drawings and described herein is adapted for use as a module on the basic structure of the Hix Rotary Printer previously identified.

Figure 2:
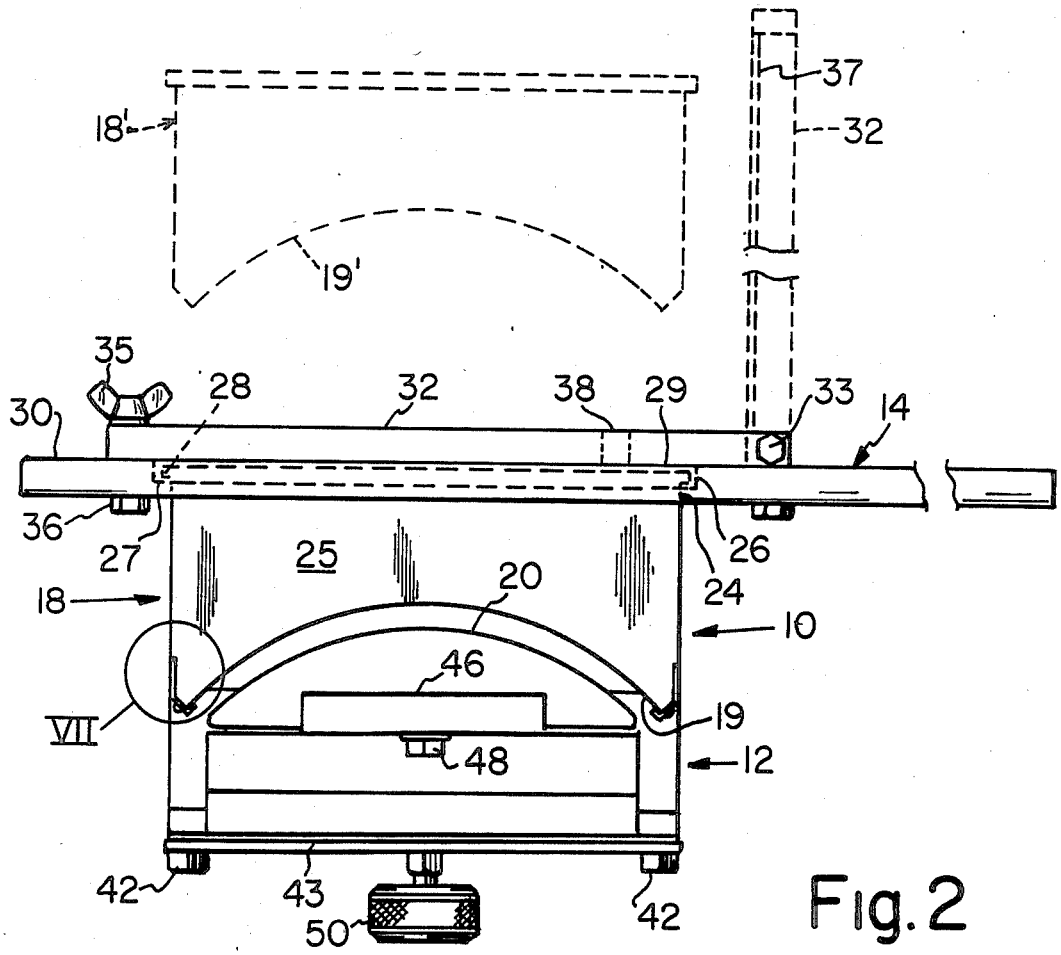
FIG. 2 is a side elevation of the screen print assembly of FIG. 1 showing its position relative to the preferred form of cap mount assembly used in printing with the apparatus, the alternate positions of the cover and screen holder being shown in dashed lines.
Figure 3:
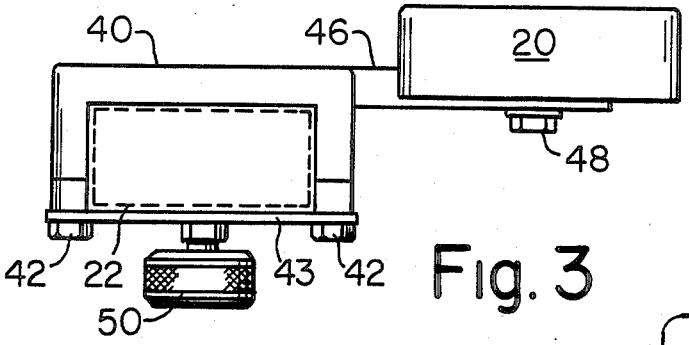
FIG. 3 is a side elevation view of the cap mount assembly taken at 90° to the elevation of FIG. 2.
Figure 4:
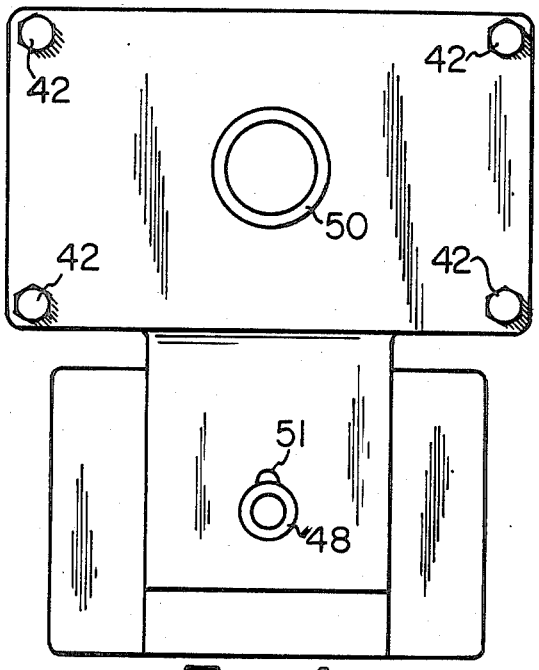
FIG. 4 is a bottom plan view of the cap mount assembly of FIG. 3.
Figure 5:
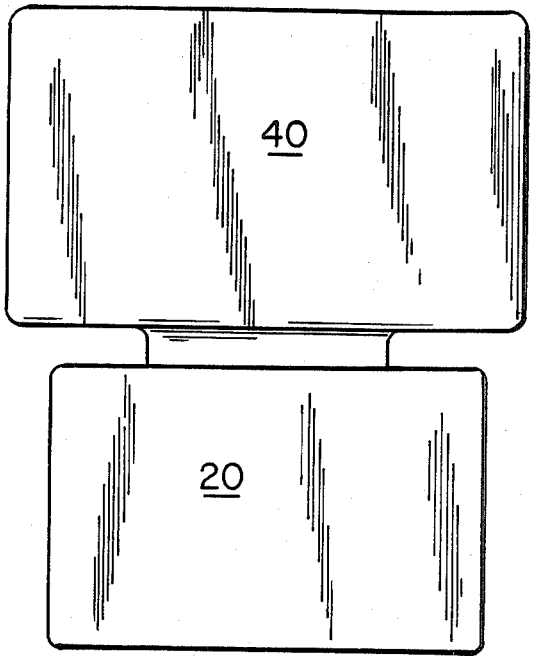
FIG. 5 is a top plan view of the cap mount assembly of FIG. 3.

Referring to FIGS. 1 and 2, the preferred screen printing apparatus includes two basic assemblies, a screen print assembly 10 and a cap or hat mount assembly 12. The screen print assembly 10 preferably includes a plate 14 for mounting the assembly 10 to the T-bolts provided at each station of the Hix Rotary Printer although the plate may be mounted independently, for example on a standard or the like as shown in U.S. Pat. No. 4,590,854. When used on the Hix Rotary Printer machine, the T-bolts extend through the holes 16 in the plate for mounting of the plate on an operating arm attached to the upper spindle disk of the machine. It will be noted that the end of the plate is preferably offset, such that, when in position, the screen holder 18 with screen 19 mounted thereon included in the screen print assembly 10 will extend vertically over platen 20 of the hat mount assembly 12 when the assembly 12 is mounted on one of the rectangular cross-section bars 22 which extend radially from the lower spindle disk in the center of the Hix Rotary Printer (see FIG. 3). IF the plate 14 does not include an offset portion, the platen 20 is mounted over a bar 22 so that the screen holder is positioned above the platen for printing.

The plate 14 includes a substantially rectangular opening 24 of a size slightly larger than the outer perimeter of wall 25 of the screen holder 18, such that the screen holder is adapted to fit closely within the opening 24 when the screen holder is placed therein. The top of the opening 24 is increased to form an extended opening 26 which provides a shoulder 27 around the opening 24. A flange or lip 28 extending around the upper portion of the wall 25 is adapted to be seated on shoulder 27 such that the screen holder is supported in the plate 14 of the screen print assembly 10. The to surface 29 of the flange or lip 28 is either flush with or below the top surface 30 of the plate 14 to permit the top of the screen holder to be sealed by a cover 32. The cover is pivotally mounted on one end by a bolt 33 which extends through the end and through hinges 34 on plate 14 and adapted to be locked in position by a wing nut 35 threaded to a bolt 36 fixed to plate 14 on the opposite end of the cover. An O-ring 37 extends around the inside of the cover opposite the extended opening 26 to seal the entire assembly against air leakage when the cover is locked in position by the wing nut. The cover 32 includes an opening 38 for communication with a source of compressed air, not shown, for introduction of air to the inside of the screen holder. As shown in FIG. 2, the cover 32 is adapted to be pivoted into the position shown in dashed lines to permit a screen holder 18' (also shown in dashed lines) with its screen 19' to be lifted from the plate 14 and replaced by another screen holder with screen mounted therein.

In U.S. Pat. No. 4,590,854, the screen print assembly was secured to a standard and a hat mount assembly carrying a cap to be printed was raised so that the surface of the cap contacted the bottom of the screen for printing. Although the screen print assembly 10 and hat mount assembly 12 of the present invention may be mounted for operation in the same manner, the preferred mode is for the hat mount assembly 12 to be fixed relative to the screen print assembly 10 which is raised and lowered in accordance with the operation of the operating arm of the Hix Rotary Printer apparatus. According to the structure and operation of that machine, which is not part of the present invention per se, the screen print assembly is mounted such that it moves in the manner of an A-frame in the direction of the cap mount assembly and in approximately the last two inches of travel the screen print assembly 10 is adapted to move substantially vertically to provide contact between the screen surface and the substrate mounted on the fixed cap mount assembly 12 in order to produce a definitive image or indicia on the substrate.

The preferred cap mount assembly, as shown in FIGS. 2–5 includes a U-shaped channel member 40 which is adapted to be secured in position on a bar, such as radially extending bar 22 of the Hix Rotary Printer, by bolts 42 across plate 43. A platen 20, either flat or, as shown in the drawings, curved to conform with the curvature of the screen used, is mounted on an extending member 46 by bolt 48. The height of the platen is adjustable using a conventional hand adjustment means controlled by a knob 50. The position of the platen on the member 46 may be precisely controlled by adjustment of the member which includes a slot 51 through which bolt 48 extends.

As previously mentioned, the screen and platen may be flat or curved depending upon the configuration of the substrate to be printed. To provide a predetermined indicia on a substrate, the screen may be presensitized in accordance with well-known techniques as described in U.S. Pat. No. 4,590,854 and then mounted on a screen holder, such as the screen holder of the present apparatus. To permit quick, easy and accurate installation of a screen on a screen holder, an improved means for preregistered mounting of the screen has been provided which is applicable to flat and curved screens. The mounting means insures that a substantial seal is provided between the screen frame and the depending or bottom wall edges of the screen holder. In the case of a curved screen, the mounting means also provides the screen with additional tautness which removes any inconsistencies in the screen fabric surface which would adversely affect the quality of the printed image upon contact of the fabric surface and the surface of the substrate by permitting ink to flow horizontally between the two surfaces rather than directly onto the substrate being printed.

Figure 6:
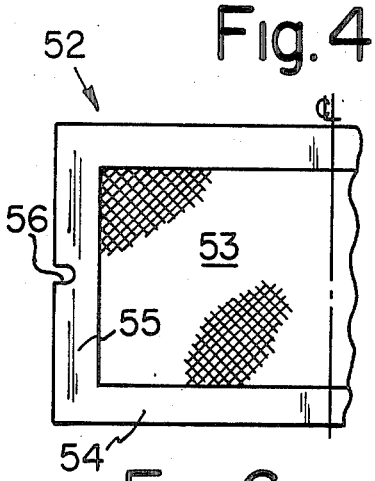
FIG. 6 is a top plan view of one end of a screen preferred for use with the screen print assembly of FIG. 1.

FIG. 6 shows a portion of a rectangular screen 52 adapted for use as either a flat or a curved screen. The screen fabric 53 is conventional and is stretched on a frame consisting of two sides 54 and two ends 55. Each end includes, at or near the center thereof, a slot 56 for locating the screen in a screen holder.

Figure 7:
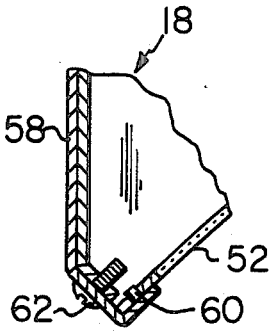
FIG. 7 is a cross-sectional, enlarged view of one end of the screen print assembly in the circle VII showing the clip means for mounting a curved screen to the screen holder.
Figure 8:
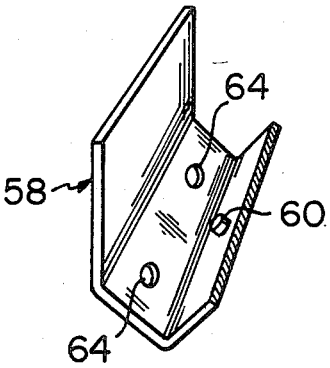
FIG. 8 is a perspective view of the clip means of FIG. 7.
Figure 9:
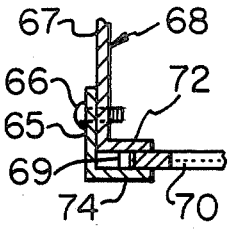
FIG. 9 is a cross-sectional, enlarged view of one end of a screen holder showing a clip means for mounting a flat screen to the screen holder.

When used as a curved screen in a holder as shown in FIGS. 2 and 7, the screen 52 is mounted at each end on the bottom edges of the screen holder 18 by a U-shaped clip 58 (see FIG. 8), one leg section of which carries an upstanding pin 60 which is adapted to engage in slot 56 of the screen. The clip is mounted on the screen holder 18 by means of fasteners, such as screws 62, which extend through holes 64 in one of the other two leg sections of the clip and are threaded into corresponding threaded holes in the ends of the screen holder. By tightening the screws 62, the pin carried by the clip is forced tightly into the slot 56 forcing the screen 52 to assume the precise curvature of the bottom edges of the screen holder 18 to provide a tight seal between the sides and ends of the screen frame and the bottom edges of the screen holder. In the case of a flat screen, an L-shaped clip 65 is used, as shown in FIG. 9, which performs the same function by means of screws 66 which are threaded into the depending wall 67 of screen holder 68 such that pin 69 engages tightly in slot 56 of the screen frame 70. The end of the screen frame is retained between the flange or lip 72 of wall 67 and the leg 74 of clip 65.

Although the improved clip means for mounting the screen is not essential for the enjoyment of the features of the improved printing apparatus described herein, it is preferable to those mounting means presently used since it facilitates sealing of the screen holder, replacement of screens for sensitizing and cleaning and for proper registration of the screen on the screen holder.

The present invention provides improved direct screen printing of substrates using compressed air at constant pressure for forcing ink onto a substrate in accordance with the teachings of U.S. Pat. No. 4,590,854. Air at constant pressure is applied for a predetermined time to the ink in the screen holder and, without relief, forces ink through the screen onto the substrate.

Using the method, each cap is printed with a quality image at about 4 psi air pressure in about 1.3 seconds so the process is substantially continuous except for replacing printed caps with caps to be printed. Each cycle takes a total of about 6 seconds.

Having described presently preferred embodiments of the present invention, it is to be understood that they may be otherwise embodied within the scope of the appended claims.

I claim:

1. Screen printing apparatus for directly printing indicia on a substrate using fluid pressure, said printing apparatus including:

at least one screen print assembly including a screen holder having a screen upon which ink can be placed;

exterior flange means extending around said screen holder for removably supporting said screen holder in said screen print assembly;

closure means for said screen holder;

means on said closure means for sealing said screen holder in said screen print assembly; and means for introducing fluid under pressure to said screen holder to force ink through said screen to print indicia on said substrate, whereby said exterior flange means supports said screen holder in said screen print assembly.

2. Screen printing apparatus as set forth in claim 1 including means for mounting said screen on said screen holder.

3. Screen printing apparatus as set forth in claim 2 wherein said screen mounting means includes a clip at each end of the screen holder for attaching the screen to the holder, each end of the screen including a slot, and each clip including a pin for engagement in the slot to force said screen tightly against bottom edges of the screen holder.

4. Screen printing apparatus as set forth in claim 1 wherein the closure means is a cover.

5. Screen printing apparatus as set forth in claim 4 wherein the cover is pivotally mounted on the apparatus.

6. Screen printing apparatus as set forth in claim 1 including means for mounting the substrate and wherein said screen is curved, and said substrate mounting means includes a curved platen for cooperation therewith.

7. Screen printing apparatus as set forth in claim 1 including means for mounting the substrate and wherein said screen in flat, and said substrate mounting means includes a flat platen for cooperation therewith.

8. Screen printing apparatus as set forth in claim 1 including means for mounting a substrate wherein said substrate mounting means is adjustable to provide the cooperation between said screen and the substrate during printing.

9. Screen printing apparatus as set forth in claim 1 including means forming a part of the screen print assembly for attaching said apparatus to a printing machine.

10. Screen printing apparatus as set forth in claim 9 wherein said attachment means comprises a plate having an offset portion.

11. A screen print assembly comprising:

a screen holder having a screen upon which ink can be placed;

exterior flange means extending around said screen holder for removably supporting the screen holder in a screen printing apparatus;

closure means for said screen holder;

means on said closure means for sealing said screen holder in said screen print assembly; and means for introducing fluid under pressure to said screen holder to force ink through said screen to print indicia on a substrate, whereby said exterior flange means supports said screen holder in said screen print assembly.

12. A screen print assembly as set forth in claim 11 wherein the closure means is a cover.

13. A screen print assembly as set forth in claim 12 wherein the cover is pivotally mounted on the screen printing apparatus.

14. A screen print assembly as set forth in claim 11 wherein said screen is curved.

15. A screen print assembly as set forth in claim11 wherein said screen is sensitized.

16. A screen print assembly as set forth in claim 11 and including means for mounting the screen including a clip at each end of the screen holder for attaching the screen to the holder, each end of the screen including a slot, and each clip including a pin extending substantially vertically from the plane of the clip for engagement in the slot to force said screen tightly against bottom edges of the screen holder.

17. A clip for mounting a framed screen in registration on bottom edges of a screen holder wherein each end of the screen frame includes a slot, said clip including three leg sections, two of which form an obtuse angle and including means for attaching the clip to the screen holder, said attachment means being in one of the two leg sections and a pin extending from the third of said leg sections for engagement with said slot in the screen frame.

* * * * *

UNITED STATES PATENT AND TRADEMARK OFFICE
Certificate

Patent No. 4,702,165 Patented: Oct. 27, 1987

On petition requesting issuance of a certificate for correction of inventorship pursuant to 35 U.S.C. § 256, it has been found that the above-identified patent, through error and without any deceptive intent, improperly sets forth the inventorship.

Accordingly, it is hereby certified that the correct inventorship of this patent is: Ronald C. Anderson and Clifford A. Hix.

Signed and Sealed this Fifth Day of March, 1991.

EDGAR S. BURR, *SPE*

*Art Unit 337*